US011344173B2

(12) United States Patent
Tang et al.

(10) Patent No.: US 11,344,173 B2
(45) Date of Patent: May 31, 2022

(54) CLEANING ROBOT AND CLEANING CLOTH BRACKET

(71) Applicant: ECOVACS ROBOTICS CO., LTD., Suzhou (CN)

(72) Inventors: Zeheng Tang, Suzhou (CN); Shoumu Wang, Suzhou (CN); Jinting Bi, Suzhou (CN)

(73) Assignee: ECOVACS ROBOTICS CO., LTD., Suzhou (CN)

( * ) Notice: Subject to any disclaimer, the term of this patent is extended or adjusted under 35 U.S.C. 154(b) by 145 days.

(21) Appl. No.: 16/978,170

(22) PCT Filed: Mar. 4, 2019

(86) PCT No.: PCT/CN2019/076861
§ 371 (c)(1),
(2) Date: Sep. 3, 2020

(87) PCT Pub. No.: WO2019/170054
PCT Pub. Date: Sep. 12, 2019

(65) Prior Publication Data

US 2021/0038047 A1 Feb. 11, 2021

(30) Foreign Application Priority Data

Mar. 9, 2018 (CN) ..... 201810193707.7

(51) Int. Cl.
*A47L 11/40* (2006.01)
*A47L 11/28* (2006.01)

(52) U.S. Cl.
CPC ..... *A47L 11/4058* (2013.01); *A47L 11/28* (2013.01); *A47L 11/4011* (2013.01);
(Continued)

(58) Field of Classification Search
CPC .. A47L 11/4058; A47L 11/28; A47L 11/4011; A47L 11/4036; A47L 11/4061; A47L 2201/04
(Continued)

(56) References Cited

U.S. PATENT DOCUMENTS 4,888,843 A * 12/1989 Smith ..... A47L 11/4069 411/510
8,978,190 B2 * 3/2015 Leifheit ..... A47L 11/162 15/49.1

FOREIGN PATENT DOCUMENTS

CN 201135409 Y 10/2008
CN 202386626 U 8/2012
(Continued)

OTHER PUBLICATIONS

EP Search Report in Application No. 19763989.1 dated Mar. 26, 2021.

*Primary Examiner* — Joseph J Hail
*Assistant Examiner* — Caleb Andrew Holizna
(74) *Attorney, Agent, or Firm* — Maschoff Brennan

(57) ABSTRACT

Provided are a cleaning robot and a cleaning cloth bracket for the cleaning robot, including a cleaning cloth bracket, where the cleaning cloth bracket includes a main body, a soft member and a raised portion, a cleaning cloth is provided under the cleaning cloth bracket, the cleaning cloth bracket is floatingly disposed at a bottom of a base of the cleaning robot, the raised portion is provided at a front end of the main body through the soft member, and the raised portion is in contact with the bottom of the base. According to the present disclosure, by increasing the height of the raised portion and providing the soft member between the raised portion and the main body of the cleaning cloth bracket, the range of application of the cleaning robot is improved, the
(Continued)

cleaning robot is allowed to overcome higher obstacles, and the cleaning efficiency is improved.

13 Claims, 1 Drawing Sheet

(52) U.S. Cl.
CPC ..... *A47L 11/4036* (2013.01); *A47L 11/4061* (2013.01); *A47L 2201/04* (2013.01)

(58) Field of Classification Search
USPC ..... 15/98
See application file for complete search history.

(56) References Cited

FOREIGN PATENT DOCUMENTS

| | | | |
|---|---|---|---|
| CN | 102727148 | A | 10/2012 |
| CN | 203736126 | U | 7/2014 |
| CN | 107007219 | A | 8/2017 |
| CN | 206414238 | U | 8/2017 |
| EP | 1 654 974 | A1 | 5/2006 |
| KR | 2012-0015477 | A | 2/2012 |
| KR | 20150073735 | A | 7/2015 |

* cited by examiner

CLEANING ROBOT AND CLEANING CLOTH BRACKET

TECHNICAL FIELD

The present disclosure relates to a cleaning robot and a cleaning cloth bracket for the cleaning robot, which belongs to the field of small household appliances manufacturing technology.

BACKGROUND

At present, the floor cleaning robots with mopping function on the market, the cleaning cloth bracket of which can only be lowered by its own gravity, or it is completely fixed and cannot move. When encountering obstacles such as steps, since it cannot be lifted up, the cleaning cloth and the cleaning cloth bracket press against the obstacles, and the robot is stuck, resulting in a reducing of the cleaning efficiency.

Chinese application disclosure No. 201710451102.9 discloses a mopping robot, including a bracket and an elastic body, where the bracket has a curved side wall, so that the bracket can be smoothly lifted by the protrusion on the ground, thereby reducing the probability of the cleaning cloth and the cleaning cloth being pressed against. However, since the bracket cannot deform, when the bracket is lifted by the protrusion, it is separated from the ground, and the ground around the protrusion cannot be in contact with the cleaning cloth and cannot be effectively cleaned. In addition, since there is a gap between the side wall and the supporting plate, when the height of the obstacle is between the side wall and the supporting plate, the robot will still get stuck, which reduces the efficiency of the robot and makes the user experience a poor experience.

SUMMARY

The technical problem to be solved by the present disclosure is to provide a cleaning robot, by increasing the height of the raised portion and providing the soft member between the raised portion and the main body of the cleaning cloth bracket, the range of application of the cleaning robot is improved, the cleaning robot is allowed to overcome higher obstacles, and the cleaning efficiency is improved.

The technical problem to be solved by the present disclosure is achieved by the technical solution below:

The present disclosure provides a cleaning robot, including a cleaning cloth bracket, where the cleaning cloth bracket includes a main body, a soft member and a raised portion, a cleaning cloth is provided under the cleaning cloth bracket, the cleaning cloth bracket is floatingly disposed at a bottom of a base of the cleaning robot, the raised portion is provided at a front end of the main body through the soft member, and the raised portion is in contact with the bottom of the base.

Preferably, the raised portion comprises an inclined surface or an arc surface.

Preferably, the soft member comprises an elastic piece, a cloth cover, or a rubber.

In order to make the raised portion contact with the base, the raised portion is connected to the bottom of the base through means of gluing, riveting or buckling. Alternatively, the raised portion abuts against the base by support force provided by the soft member.

In order to achieve better cleaning effect, the main body is at least partially composed of a plurality of soft brackets.

Preferably, the soft brackets are in a shape of a bar, a longitudinal direction of the soft brackets is perpendicular to a forward direction of the cleaning robot, and the plurality of the soft brackets are arranged at intervals along the forward direction of the cleaning robot.

Preferably, each of the soft brackets is in a shape of a triangle, and the soft brackets are evenly distributed on the main body.

In order to prevent the soft member and the raised porting from being polluted by the dirt, the cleaning cloth is wrapped below the soft member and the raised portion.

Preferably, one end of the elastic member abuts the main body, and the other end abuts the bottom of the base.

In conclusion, according to the present disclosure, by increasing the height of the raised portion and providing the soft member between the raised portion and the main body of the cleaning cloth bracket, the range of application of the cleaning robot is improved, the cleaning robot is allowed to overcome higher obstacles, and the cleaning efficiency is improved.

The technical solution of the present disclosure will be described in detail below with reference to the drawings and specific embodiments.

DETAILED DESCRIPTION OF EXAMPLE EMBODIMENTS

Figure 1:
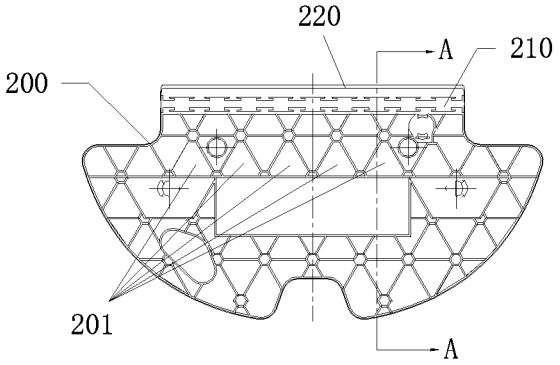
FIG. 1 is a schematic structural diagram of a cleaning cloth bracket of the present disclosure.
Figure 2:
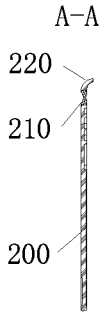
FIG. 2 is a cross-sectional view taken along line A-A of FIG. 1.
Figure 3:
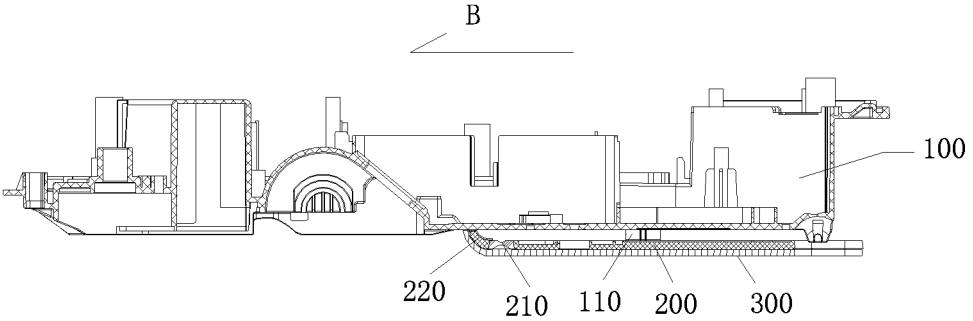
FIG. 3 is a schematic structural view of a cleaning cloth bracket of the present disclosure assembled on a base.

As shown in FIGS. 1 to 3, the present disclosure provides a cleaning robot. A base 100 of the cleaning robot is provided with an elastic member 110 and a cleaning cloth bracket. One end of the elastic member 110 abuts the cleaning cloth bracket, and the other end abuts a bottom of the base 100. The cleaning cloth bracket is floatingly disposed at the bottom of the base 100 through the elastic member 110. A cleaning cloth 300 is also provided under the cleaning cloth bracket.

The cleaning cloth bracket includes a main body 200, a soft member 210 and a raised portion 220. Taking the forward direction B of the cleaning robot as the front, the raised portion 220 is provided at the front end of the main body 200 through the soft member 210, and the raised portion 220 is in contact with the bottom of the base 100.

The soft member 210 deforms when subjected to an applied force. Preferably, the soft member 210 is an elastic piece, a cloth cover, or a rubber. The shape of the raised portion 220 preferably comprises an inclined surface (that is, the raised portion 220 comprises a plane, and there is an angle between the plane and the ground) or an arc surface (as shown in FIG. 2 and FIG. 3). The contact between the raised portion 220 and the bottom of the base 100 may include various situations. For example, the raised portion 220 and the bottom of the base 100 may be connected and contacted by means of gluing, riveting, or buckling, or the raised portion 220 may abut against the base 100 by support force provided by the soft member 210.

When the height of the obstacle in front of the cleaning robot is higher than the minimum height of the base 100, a detection unit located on the base of the cleaning robot 100 may detect the orientation of the obstacle and send a detection signal of the orientation of the detected obstacle to the control unit of the cleaning robot, so that the control unit instructs the cleaning robot to walk and avoid the obstacle. When the height of the obstacle in front of the cleaning robot is lower than the minimum height of the base 100, since the raised portion 220 is in contact with the bottom of the base 100, during the cleansing robot walks toward the obstacle, the obstacle comes into contact with the raised portion 220, and the raised portion 220 is lifted upward by the obstacle. At this time, the soft member 210 is deformed, and the end connected to the raised portion 220 follows the rising of the raised portion 220, and the position of the end connected to the main body 200 remains unchanged, that is, in the present disclosure, when the raised portion 220 is lifted by an obstacle, the position of the main body 200 remains unchanged due to the presence of the soft member 210, so as to ensure that the cleaning cloth 300 always adheres to the ground. Compared with the cleaning cloth bracket that is directly lifted when encountering obstacles, the cleaning robot in the present disclosure may wipe broader places, when dealing with dirt nearby obstacle, the clean effect is better.

As the cleaning robot continues to advance, the obstacle continues to lift the raised portion 220 upwards. When the soft member 210 reaches its deformation limit, the end connected to the main body 200 follows the rising of the raised portion 220, thereby driving the main body 200 to rise, so that the main body 200 of the cleaning cloth bracket is able to pass over the obstacle.

In order to achieve a better cleaning effect, the main body 200 is at least partially composed of a plurality of soft brackets 201. Preferably, the material of the soft bracket 201 is the same as the soft member 210, which may be an elastic piece, cloth cover, a rubber, or the like.

The present disclosure does not limit the specific structure of the soft bracket 201. For example, the soft bracket 201 may be are in a shape of a bar, a longitudinal direction of which is perpendicular to a forward direction B of the cleaning robot, and the plurality of the soft brackets are arranged at intervals along the forward direction of the cleaning robot. The soft bracket 201 can also be in a shape of a triangle, which is evenly distributed on the main body 200 (as shown in FIG. 1).

In order to prevent the soft member 210 and the raised portion 220 from being contaminated by dirt, preferably, the lower portion of the soft member 210 and the raised portion 220 are wrapped with a cleaning cloth 300.

The working process of the cleaning robot of the present disclosure will be described below in conjunction with specific scenarios.

For example, when the cleaning robot cleans the mall, there may be projections such as underground lights or pop-up plugs on the floor of the mall.

Taking the projections being the pop-up plugs as an example, regarding the conventional cleaning robot, since there is a gap between the side wall of the floor brush bracket and the base of the robot, when the height of the pop-up plug is between the gap, the pop-up plug will block the advance of the floor brush bracket after the pop-up plug in contact with the side wall of the floor brush bracket. In the present disclosure, since the raised portion 220 is in contact with the bottom of the base 100, there is no gap between the raised portion 220 and the bottom of the base 100. Therefore, a protrusion such as a pop-up plug may always provide upward force to the raised portion 220 to lift the raised portion 220.

On the other hand, the floor brush bracket of the conventional cleaning robot is generally made of hard plastic or the like. Even if the height of the pop-up plug is lower than the height of the side wall of the floor brush bracket, in the process of the floor brush bracket being lifted up, it is lifted up as a whole. As a result, the cleaning cloth cannot come into contact with the ground near the pop-up plug, and the dirt around the protrusion cannot be effectively cleaned. In the present disclosure, by providing a deformable soft member 210 between the raised portion 220 and the main body 200 of the cleaning cloth bracket, when the raised portion 220 is lifted up, the cleaning cloth 300 under the main body 200 remains in contact with the ground, which enlarges the cleaning range of the cleaning robot.

Further, since the main body 200 is at least partially composed of a plurality of soft brackets 201, during the process of the main body 200 crossing over the pop-up plug, only the main body 200 near the top of the pop-up plug is lifted up, and the main body 200 of other portions drop off on its own gravity with the help of a deformable soft bracket 201, so that the cleaning cloth remains in a state of being attached to the ground, and may effectively clean the dirt around the pop-up plug.

In conclusion, the present disclosure by increasing the height of the raised portion and providing the soft member between the raised portion and the main body of the cleaning cloth bracket, the range of application of the cleaning robot is improved, the cleaning robot is allowed to overcome higher obstacles, and the cleaning efficiency is improved.

What is claimed is:

1. A cleaning robot, comprising a cleaning cloth bracket, wherein the cleaning cloth bracket comprises a main body, a soft member and a raised portion, a cleaning cloth is provided under the cleaning cloth bracket, the cleaning cloth bracket is floatingly disposed at a bottom of a base of the cleaning robot, the raised portion is provided at a front end of the main body through the soft member, and the raised portion is in contact with the bottom of the base.

2. The cleaning robot according to claim 1, wherein the raised portion comprises an inclined surface or an arc surface.

3. The cleaning robot according to claim 1, wherein the soft member comprises an elastic piece, a cloth cover, or a rubber.

4. The cleaning robot according to claim 1, wherein the raised portion is connected to the bottom of the base through means of gluing, riveting or buckling.

5. The cleaning robot according to claim 1, wherein the raised portion abuts against the base by support force provided by the soft member.

6. The cleaning robot according to claim 1, wherein the main body is at least partially composed of a plurality of soft brackets.

7. The cleaning robot according to claim 6, wherein the soft brackets are in a shape of a bar, a longitudinal direction of the soft brackets is perpendicular to a forward direction of the cleaning robot, and the plurality of the soft brackets are arranged at intervals along the forward direction of the cleaning robot.

8. The cleaning robot according to claim 6, wherein each of the soft brackets is in a shape of a triangle, and the soft brackets are evenly distributed on the main body.

9. The cleaning robot according to claim 1, wherein the cleaning cloth is wrapped below the soft member and the raised portion.

10. The cleaning robot according to claim 1, further comprising an elastic member, wherein one end of the elastic member abuts the main body, and the other end abuts the bottom of the base.

11. A cleaning robot, comprising a cleaning cloth bracket, wherein the cleaning cloth bracket comprises a main body, a soft member and a raised portion, a cleaning cloth is provided under the cleaning cloth bracket, the cleaning cloth bracket is floatingly disposed at a bottom of a base of the cleaning robot, and the raised portion is provided at a front end of the main body through the soft member.

12. A cleaning cloth bracket for a cleaning robot, wherein the cleaning cloth bracket comprises a main body, a soft member and a raised portion, a cleaning cloth is provided under the cleaning cloth bracket, the cleaning cloth bracket is used for being floatingly disposed at a bottom of a base of the cleaning robot, the raised portion is provided at a front end of the main body through the soft member, and the raised portion is used to contact with the bottom of the base.

13. A cleaning cloth bracket for a cleaning robot, wherein the cleaning cloth bracket comprises a main body, a soft member and a raised portion, a cleaning cloth is provided under the cleaning cloth bracket, the cleaning cloth bracket is floatingly disposed at a bottom of a base, and the raised portion is provided at a front end of the main body through the soft member.

* * * * *